United States Patent [19]

Eickmann

[11] Patent Number: 4,664,018

[45] Date of Patent: May 12, 1987

[54] AXIAL PISTON MOTOR OR PUMP WITH AN ARRANGEMENT TO THRUST THE MEDIAL SHAFT INTO A SPHERICAL BED OF THE OUTGOING SHAFT

[76] Inventor: Karl Eickmann, 2420 Isshiki, Hayama-machi, Kanagawa-ken, Japan

[21] Appl. No.: 678,540

[22] Filed: Dec. 5, 1984

Related U.S. Application Data

[63] Continuation-in-part of Ser. No. 387,567, Jun. 11, 1982, abandoned, and a continuation-in-part of Ser. No. 521,874, Aug. 10, 1983, said Ser. No. 387,567, is a continuation of Ser. No. 954,555, Oct. 25, 1978, Pat. No. 4,358,078, and a continuation of Ser. No. 122,914, Feb. 19, 1980, abandoned, and a continuation of Ser. No. 224,769, Jan. 13, 1981, abandoned, and a continuation of Ser. No. 282,990, Jul. 14, 1981, Pat. No. 4,557,347, said Ser. No. 521,874, is a continuation of Ser. No. 64,248, Aug. 6, 1979, abandoned.

[51] Int. Cl.[4] ..... F01B 13/04

[52] U.S. Cl. ..... 91/485; 91/486; 91/507; 92/57

[58] Field of Search ..... 91/484–489, 91/499, 472, 504, 507; 417/269; 92/57, 71

[56] References Cited

U.S. PATENT DOCUMENTS

| | | | |
|---|---|---|---|
| 2,177,008 | 10/1939 | Shader et al. | 91/499 |
| 2,858,771 | 11/1958 | Cornelius | 92/57 |
| 2,870,746 | 1/1959 | Keel | 91/499 X |
| 3,149,577 | 9/1964 | Gregor | 91/505 X |
| 3,160,110 | 12/1964 | Budzich | 417/270 X |
| 3,181,476 | 5/1965 | Matthews | 91/485 |
| 3,188,972 | 6/1965 | Thoma | 91/485 |
| 3,253,551 | 5/1966 | Thoma | 91/485 |
| 3,589,244 | 6/1971 | Pruvot | 91/484 |
| 3,793,924 | 2/1974 | Eickmann | 91/487 |
| 4,034,650 | 7/1977 | Molly | 91/485 |
| 4,142,450 | 3/1979 | Thoma | 91/485 |

FOREIGN PATENT DOCUMENTS

| | | | |
|---|---|---|---|
| 2448384 | 4/1975 | Fed. Rep. of Germany | 91/499 |
| 2402066 | 8/1975 | Fed. Rep. of Germany | 91/504 |
| 903468 | 1/1945 | France | 92/57 |
| 1258162 | 2/1961 | France | 92/57 |
| 72504 | 6/1979 | Japan | 91/499 |
| 485237 | 8/1976 | U.S.S.R. | 91/499 |

*Primary Examiner*—Carlton R. Croyle
*Assistant Examiner*—Paul F. Neils

[57] ABSTRACT

In an axial piston motor or pump the cylinder barrel is mounted on a medial shaft which has a shoulder which axially, bears against the front end of the rotor barrel. The rear end of the medial shaft is radially borne in a housing portion. The front portion of the medial shaft is provided with a bearing member of an axial thrust bearing for support on a respective axial thrust bearing member in the housing. On the rear end of the rotary barrel an axially selfthrusting control body is provided to seal the flow of fluid to and from the cylinders of the rotary barrel. The control body presses against the rotary barrel, the rotary barrel presses against the shoulder of the medial shaft and the thrust bearing member of the shaft bears on the thrust bearing member of the housing. As a result thereof the cylinders in the rotary barrel can be straight through bores. The manufacturing of the rotor barrel is thereby simplified and the flow acceleration losses of former bag bore type cylinders are prevented.

4 Claims, 5 Drawing Figures

AXIAL PISTON MOTOR OR PUMP WITH AN ARRANGEMENT TO THRUST THE MEDIAL SHAFT INTO A SPHERICAL BED OF THE OUTGOING SHAFT

REFERENCE TO RELATED APPLICATIONS

This is a continuation in part application of my co pending patent applications Ser. No. 387,567 filed on 06/11/1982, now abandoned, and co-pending, Ser. No. 521,874 filed on 08/10/1983.

Ser. No. 387,567 was a continuation application of my earlier applications Ser. Nos. 05-945,555, now U.S. Pat. No. 4,358,078; issued on 11/9/1982; 06-122,914; now abandoned; 224,769; now abandoned; and 282,990; now U.S. Pat. No. 4,557,347, issued on 12/10/1985; and which were filed on 10/25/1978; 02/19/1980; 01/13/1981 and 07/14/1981 respectively. Ser. No. 521,874 is a continuation application of my still earlier patent application Ser. No. 06-064,248 which was filed on 08/06/1979 and which is now abandoned. Benefits of the mentioned patent applications are claimed herewith for the present patent application.

FIG. 1 is the most simple construction of the invented motor or pump and is a simplification of FIGS. 2 and 3. FIGS. 2 and 3 derive from the application Ser. No. 064,248 and FIGS. 4 and 5 derive from the application Ser. No. 122,914.

BACKGROUND OF THE INVENTION

Axial piston pumps and motors have successfully operated in great numbers. Commonly they have cylinders with ported ends, wherein the ported ends are of lesser diameter than the diameters of the cylinders are. The machining of the cylinders thereby requires a relatively difficult and costly work, because the cylinders can not be machined straight through the rotor. The cylinder ports of narrower diameter in addition require an increase of speed of fluid when the fluid flows into and out of the cylinders. That in turn causes friction and reduces the efficiency of the machine.

The common axial piston pumps and motors have intermediate rods between the pistons and the disc. The rods commonly have part-ball formed ends. The pistonward ends are commonly borne in a respective part-ball formed hollow bed in the piston and fastened into the bed in the pistons, so, that the ends of the rods can not escape from the bed of the pistons. That makes it possible to retract the pistons in a suction stroke in a pump by the rods. However, when a piston sticks in the cylinder the device breaks, because the rod can not move away from the piston. The common axial piston devices as far as here described are therefore to a certain extent dangerous in operation, especially, when life depends on their reliability as for example in aircraft applications.

In common axial piston fluid handling devices those part-ball formed ends of the intermediate rods, which are communicated to the disc are borne in part-ball-formed hollow beds in the disc, which is inclined relatively to the axis of the rotor which contains the cylinders. The rear portions of the part-ball formed ends of the intermediate rods, which are borne in the beds of the disc are commonly held by a holding ring with part-ball formed holding beds. The holding ring is fastened to the disc and the mentioned part-ball formed beds of the holding ring are fitting closely around the respective portions of the respective ends of the intermediate rods. This common system works very satisfactory in operation, however the accurate centering of the holding beds onto the respective portions of the ends of the intermediate rods is very delicate and difficult in machining.

THE AIMS AND OBJECTS OF THE INVENTION

The first object of the invention is, to provide a rotor with straight through cylinders of equal diameter from cylinder end to cylinder end in combination with a suitable control body for the control of flow of fluid into and out of the rotor.

The second object of the invention is, to prevent or to reduce friction in the flow of fluid at the entrance and exit into and from the cylinders of the device in combination with a suitable control body for the sealing and control of flow of fluid into and out of the rotor.

The third object of the invention is, to provide a medial shaft to center and support the rotor of the device.

The fourth object of the invention is, to provide a bearing of the medial shaft on one end thereof and on another end-portion thereof and to do so with little or reduced friction and leakage.

The fifth object of the invention is to provide a shoulder on the medial shaft to bear against the rotor of the device axially.

The sixth object of the invention is to fix the rotor axially between the shoulder of the medial shaft and the control body on the other end of the rotor.

The seventh object of the invention is, to hold the rear portions of the ends of the intermediate rods, which are borne in the disc by a ring with a tapered holding face in order to prevent the difficult, delicate and expensive machining of individual part-ball formed seats on the holding ring.

The eighth object of the invention is, to prevent a fastening of the intermediate rods in the beds of the pistons in order to prevent a disturbance of the device, when a piston sticks;

and the ninth object of the invention is, to guide the piston-most ends of the intermediate rods on the walls of the cylinder when a piston has stuck.

Other aims and objects of the invention may become apparent from the drawing and the description thereof. One of those additional objects is to insert flow-through restriction devices of others of my patents or patent applications into the pistons in order to assure that the pistons are at at all times pressed onto the respective ends of the intermediate rods by high pressure fluid on the bottoms of the pistons.

DESCRIPTION OF THE PREFERRED EMBODIMENTS

Figure 1:
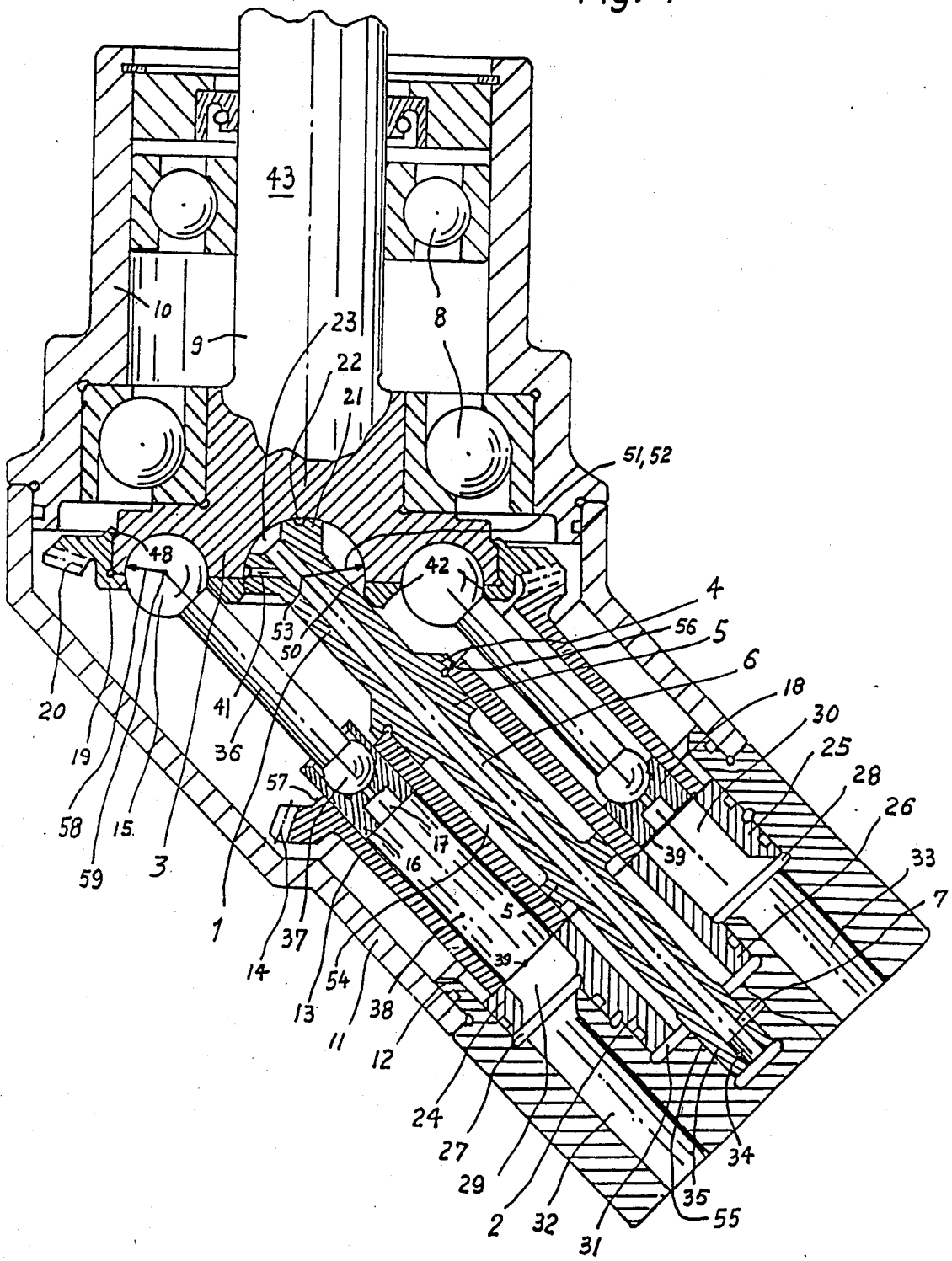
FIG. 1 is a longitudinal sectional view through an embodiment of a motor or pump of the invention.

FIG. 1 illustrates:

An axial piston motor or pump has a rotor with pistons reciprocating in its cylinders. Intermediate rods are connected to a relatively inclined rotary drive flange and are borne in or on ends of the pistons for transfer of force between the pistons and the disc. The barrel is connected to or integral with a shaft.

The rotor or barrel may be guided and be borne by a medial shaft and the medial shaft may be centered and borne at least partially by a ball part head in a seat of the disc or shaft and on the other end of the medial shaft in a rear housing portion. The medial shaft may have a shoulder to bear the rotor axially. An axially moveable control body may be led onto the back end of the rotor for the control of flow of fluid to and from the rotor and seal along the rear end face of the rotor. The rotor has cylinders, which may be straight through bores of equal diameter from end to end and the control body may be pressed by fluid in thrust chambers against the end face of the rotor whereinto the cylinders port and thereby seal the ends of the cylinders relative to areas of other pressure. The intermediate rods may have ball-part configurated ends which bear on part ball formed beds of the pistons or in part ball formed seats in the disc. The respective ends of the intermediate rods may be held in the respective seats in the disc by a tapered face of a holding ring. The pistons may be free floating pistons which are not connected to the rods, but which are pressed against the respective ends of the rods by pressure in fluid. Thereby the device is able to continue to operate, when one of the pistons sticks, because the end of the respective rod can depart from the associated piston and remains guided in the cylinder by the cylinder's wall.

More in detail, FIG. 1 shows that front housing 10 bears shaft 43 in bearings 8. Medial housing 11 connects front housing 10 with rear housing 12. Shaft 43 has on its inner end a drive flange 3, with ball-part formed seats for the individual reception of ball-part formed outer heads 15 of intermediate rods 36. Holding ring 19 is fastened to drive flange 3 and holds heads 15 in drive flange 3. The inner heads 37 of rods 36 are also ball-part configurated and are borne on beds, which are hollow and also ball-part formed, of pistons 16 or 18. The pistons reciprocate in cylinders 38.

Rotor 13 rotates in housing 11 and contains the cylinders 38. The rear end of rotor 13 forms together with the front face of the the rear control part the control mirror 39 by the tightly sealed rotation of the rotary control face of the rotor along the stationary control face of the rear control part. Inlet ports and outlet ports 32 and 33 are formed in the rear housing 12.

Fluid is let into the cylinders 38 and out thereof periodically, when the device operates. An inclination is provided relatively between the drive flange 3 and the axis of the rotor 13, whereby the intermediate rods 36 between the seats in the drive flange 3 and the beds on the pistons 16,18 define the piston stroke in the cylinders 38. The device in this way acts either as a motor when fluid under pressure is led into one of the ports 32,33 or as a pump when one of the ports 32,33 takes in fluid under lower pressure and the other of the ports expells it under higher pressure.

So far the operation of the device is known from the former art and so are the actions and locations of its parts. In the preferred embodiment of the invention the shaft 43 is integral with rotary drive flange 3. The drive flange 3 has a medial and central hollow ball-part configurated medial seat of a wider radius then common in earlier devices.

Medial shaft 1 is fastened to a central bore in rotor 13. Medial shaft 1 has a front head 21 which is part-ball configurated with a radius substantially equal to the radius of the mentioned medial seat in drive flange 3. Head 21 is borne in the mentioned medial seat and able to swing therein. Shaft 1 has also a rear end 35 which extends beyond the rotor 13 into the rear portion 12 of the device. A medial bore or passage 6 extends through medial shaft 1 but is closed on the rear end of shaft 1 for example by closure 34 or thereby, that the passage 6 does not extend through the rear end of medial shaft 1. A passage 7 leads fluid under pressure into bore or passage 6 and thereby into recess 23 between medial seat and head 21. The passage of fluid under pressure through passage 7 into passage 6 is done either by supply from the outside or by communication of passage 7 to those of ports 32 or 33 which contains the fluid under the higher pressure. Such communication is known from my U.S. Pat. No. 3,793,924 and the communication means of said patent may be associated to passage 7. The known communication is not shown in the Figure of the drawing and passage 7 is shown in part in the drawing. Shaft 1 is seated by fittings 5 in the central bore or hub of rotor 13 and a shoulder 4 of shaft 1 bears on the front end of rotor 13, embracing a portion of the front face of rotor 13. Rotor 13 is pressed by fluid in control ports 29 or 30 towards the shoulder 4 of shaft 1 and medial shaft 1 is pressed by the force onto the shoulder 4 into the medial seat in disc 3. In order to obtain this force of pressure in fluid against the rotor 13, the control ports 29 and 30 are respectively so dimensioned, that their cross-sectional area is larger than the cross-sectional area of the rear end face of the rotor 13 adjacent the control ports 29 and 30. In order to assure a smooth slide of head 21 in the medial seat, there may be an annular groove 22 between the medial seat in 3 and the head 21. It may be supplied with high pressure fluid through communication with passage 6 for example by communication 41. Thereby the medial ball-formed portion of the faces of medial seat in drive flange 3 and head 21 of shaft 1 are lubricated from two ends by high pressure fluid. The swinging motion of head 21 in the medial seat in drive flange 3 therefore takes place at smallest friction. The arrangement of the invention described in this paragraph provides the radial and axial guide of the rotor at the rotor's rotation without any further bearings or means. Because the rotor 13 is kept by medial shaft 1 while medial shaft 1 is held on one end on medial seat of drive flange 3 and on the other end by seating with its cylindrical rear end portion 35 in a cylindrical seat in the rear portion 12 of the device. Ends 15 of intermediate rods 36 swing in the individual beds in drive flange 3. They are kept therein as known in the art by a ring 19. In the former art however, ring 19 had individual holding faces for each head 15. According to one object of the invention the expensive and delicate machining of such individual holding seats is spared by the application of a common face, for example a slightly tapered annular face 42 of the invention. This face grabs or embraces the rear portions of the heads 15 of rods 36 only in a point, but since there is no load, the retaining of the outer heads 15 in their respective seats in drive flange 3 is enough force to prevent an accidental escape, when there is no pressure in the device. At times of pressure in the device, there is no holding of the heads 15 required, because each cylinder has at all times in operation at least so much pressure in this device, that the pistons 16,18 remain pressed against the rods 36 and the rods 36 remain pressed into their individual seats in drive flange 3, because the device of this invention is not intended to operate mainly as a self-suctioning pump, but operate mainly as a motor or as a pump with pre-pressure in the to-flow ports in a closed cycle.

According to another object of the invention, the holding ring 19 is fastened to drive flange 3 by retaining portions 48 which embrace a rear shoulder of drive flange 3. The embracing may be done by deforming the retainers 48 inwardly after the holding ring 19 is mounted over the drive flange 3. Drive flange 3 and rotor 13 may be provided with coupling means 20, for example gears 20 for the coupling of the drive flange 3 and rotor 13 to revolution in unison.

According to another object of the invention, the pistons 16,18 are free-floating pistons. That means, that the pistons are not connected to the rods 36. On the contrary, the pistons 16.18 could move independently of the intermediate rods 36. This is obtained thereby, that the inner end heads 37 of the intermediate rods 36 are not embraced backwards by holding members or portions of the pistons. Thereby they are free to leave the piston and to depart from the hollow part-ball formed bed of the respective piston 16 or 18. At times of pressure in the respective cylinder 38 behind the piston, the piston is pressed against the inner head 37 of the respective intermediate rod 36 and the inner head 37 of rod 36 centers itself by its spherical form into the spherical hollow bed on the adjacent end of the piston. The feature of this object of the invention is, that when a piston 16 or 18 sticks in a cylinder, the rod 36 can move away from the respective piston and the device does not break. The piston will then be forced into the deepest location in the respective cylinder, remain there stuck and come to rest. The respective intermediate rod 36 will then move freely deeper into and partially out of the respective cylinder 38 whereby the outer face of the inner head 37 moves along the inner wall of the respective cylinder, whereby the intermediate rod 36 remains guided by the wall of the cylinder 38 when it has departed from the respective bed of the respective piston 16 or 18. The length of the intermediate rods is so dimensioned that at all locations of the piston stroke or of the rod 36's movement at least one half of the inner head 37 remains within a cylinder 38. When one of the pistons sticks, the motor or pump loses the uniformity of flow and a certain non-uniformity of flow appears. However, the motor or pump can continue to work with the rest of the undisturbed and unstuck pistons until the vehicle or machine wherein the device operates can be set to rest. This feature of the invention is especially important in aircraft with vertical propeller axes, like helicopters or, when the device is used to drive a propeller as fluid motor. The conventional motor of the former art would break, when a piston sticks and the helicopter would then crash. But in case of application of the motor as a helicopter propeller driving fluid motor the motor may continue to work with one or a few pistons stuck until the helicopter has effected an emergency landing.

Rear housing 12 may have a stationary control face to form a control mirror 39 with the rotary control face of the rotor 13. But instead of being a solid portion, the rear housing 12 may also be formed with inner space(s) to receive a control body 2 as demonstrated in the Figure of the drawing. Control body 2 may have an innermost centric portion 24 to form the stationary control face of control mirror 39. An eccentric medial portion 25 may be located behind the innermost portion 24 and an again centric portion 26 of smaller diameter may be located as end portion behind the medial eccentric portion 25. Thrust chambers 27 and 28 are thereby formed behind the innermost portion 24 and the medial portion 25. The pressure in fluid in these thrust chambers presses the control body 2 with a suitable but not too strong force against the endface of the rotor to close the control mirror 39 there. Control ports 29 and 30 are provided in the innermost portion 24 to control the flow of fluid into and out of the cylinders 38 of the rotor 13. They are communicated to the thrust chambers 27 or 28 respectively and the ports 32,33 are porting into the thrust chambers 28 or 28 respectively. Fluid now flows through a port 32 or 33 into and through a thrust chamber 27 or 28, through innermost portion 24 of control body 2 and through control port 29 or 30 into the respective cylinders 38 and out thereof in the oppsite direction. The cross-sectional areas of the thrust chambers 27,28 and of the portions 24,25 on the one end define in combination with the fluid forces in the control mirror 39 on the other end the remaining force which with the stationary control face of portion 24 is pressed against the rotary control face of rotor 13 in the control mirror 39.

The application of control body 2 of the Figure of the drawing is by way of example only. Instead control bodies may be utilized such as, for example those of my U.S. Pat. Nos. 3,831,496; 3,850,201; 3,862,589; 3,889,577; 3,960,060 or thrust pistons and thrust chambers of my U.S. Pat. Nos. 3,398,698; 3,561,328; or 3,697,201. The medial shaft 1 is in the invention commonly extended through the medial bores of the respective control body; for example as shown in the drawing. In case of application of my control body of my U.S. Pat. No. 3,960,060 however, the shaft 1 may have to be extended through a thrust chamber and then have to be sealed in the control body and in the housing portion behind the control body in order to prevent leakage out of the thrust chamber. It is most suitable to bear the rear end of shaft 1 as a cylindrical portion in a fitting diameter of a cylindrical wall in the rear portion of the housing, which means in housing portion 12. In rare cases the rear end of the medial shaft may however also be borne in the respective control body.

The several embodiments described in the specification may be applied either singly or in combination. For example the arrangement of the medial shaft 1 may also be applied in those axial piston devices, which do not employ the free-floating pistons. The pistons may be either of the type of referential 16 or of the type of referential 18 of FIG. 1, or of commonly used pistons which bear fastened rod heads within the pistons. The pistons may have spaces 17 for the reception and mounting of flow-through restrictions for example of my co-pending application Ser. No. 765,221 or others or of others of my patents or applications for radial piston devices. Pistons 16 may have their beds deeply inside of the piston, while alternative pistons 16 may have their beds for bearing of the inner heads 37 of rods 36 on the respective ends on the pistons 18. Thus, heads 37 may either lay inside of pistons 16 or on the bed on the end of pistons 18. The free-floating pistons and rods may also be applied in common axial piston devices and so the holding rings 19 or parts thereof. The gist and content of the invention shall therefore be restricted only by the appended claims.

The terms "control-mirror" or "control-fit" in the specification or claims define two complementary faces laying or moving closely on each other.

In a deeper study of the embodiment it will be seen, that there are different places, where members are swinging in respective beds. It is therefore suitable to give those different places respective definitions.

Accordingly, the head 21 of the medial shaft may have a first swing center. The sliding faces thereof are formed by first and second radii. The heads 15 of the intermediate rods 36 may form second swing centers and the sliding faces associated thereto may have third and fourth radii. The inner heads 37 of the intermediate rods 36 may form third swing centers with fifth and sixth radii of the thereto associated sliding faces.

The embodiments of the invention may then be described, for example, as follows:

An axial type hydraulic or pneumatic device, wherein fluid flows in a plurality of substantially axially cylinders 30 in a substantially cylindrical barrel 13, wherein pistons 16 reciprocate in said cylinders in said barrel, wherein a drive flange 3 contains seats for the bearing and reception of intermediate rods 36 between said drive flange and said pistons, wherein the axis of said drive flange is inclined relatively to the axis of said barrel and thereby defines, guides and limits the strokes of said pistons in said cylinders; wherein said drive flange and said barrel are located in a common housing 10,11, wherein said housing contains in one of its portions entrance ports 32,33 and exit ports, 32,33, wherein a ported control face 39 is provided in a portion of said housing to closely seal along a complementary control face 39 on one end of said barrel to form a control fit 39 between said control faces 39 for the control of flow of fluid from one of said ports into said cylinders and out of said cylinders into the other of said ports;

wherein the said drive flange 3 has a medial hollow spherical seat 50 a first radius 51 around a first seat center 53;

wherein said barrel is hollow and forms a central hub wherein said housing contains a first cylindrical seat in one of its portions;

wherein a medial shaft 1 extends through said hub of said barrel and into said medial seat and into said first cylindrical seat;

wherein said medial shaft forms at one end of said shaft a part-ball formed head 21 of a second radius 52 and on the other end of said shaft a first cylindrical portion 35 of a diameter able to closely fit and move in said first cylindrical seat;

wherein said head of said medial shaft is swingably borne in said hollow medial spherical seat of said driven flange while said second radius is substantially equal but very slightly shorter than said first radius to enable said head to swing in said medial seat and maintain a close fit between the faces of said head and said medial seat;

wherein said medial shaft forms a shoulder 4 with a substantially radial plane face 56 wherein said shaft forms at least one fitting 5 to fit in said hub of said barrel 13 to bear against said barrel radially;

wherein said radial plane face 56 extends radially beyond said at least one fitting 5 to bear in axial direction on said radial plane face 56 a substantially radially plane face 57 which is substantially located close to the other end of said barrel, wherein said first cylindrical portion of said medial shaft is borne in said first cylinder seat of said housing portion; and wherein said barrel is axially kept between said radial plane face of said shoulder of said medial shaft and said stationary control face in said portion of said housing.

Or, as

The device of the above, wherein said barrel is a rotor and said drive flange is rotary and borne in respective bearings;

and wherein a coupling means is provided between said rotor and said disc to revolve said disc and said barrel in unison.

Or, as:

The device of the above, wherein one of said portions of said housing is hollow and forms at least one thrust-chamber 27,28;

wherein an axially movable body 2 is inserted into said at least one thrust chamber;

wherein force of high pressure fluid in said at least one thrust chamber presses said axially movable body 2 against said barrel 13;

wherein said barrel 13 is pressed by said axially movable body 2 against said shoulder 4 of said medial shaft 1, and, wherein said barrel is axially kept between said shoulder of said medial shaft and said axially movable body while said medial shaft 1 is axially borne by said part-ball formed head 21 of said medial shaft in said medial hollow spherical seat 50 and radially borne in said medial hollow seat and said first cylindrical seat.

Or, as:

The device of the above, wherein said barrel is axially and radially borne by said medial shaft.

Or, as:

The device of the above, wherein said axially movable body forms said control face, wherein said body forms control ports in said control face, wherein said body has passages to communicate at least one of said control ports with said at least one thrust chamber;

wherein said control face in non-rotary, wherein said barrel forms on the end adjacent to said control face said complementary control face as a rotary control face whereinto said cylinders part, and, wherein said control faces form said control-fit.

Or, as:

The device of the above, wherein said cylinders are straight cylinders which extend with equal diameter through the entire length of said barrel.

Or, as:

The device of the above, wherein said cylinders are straight cylinders which extend with equal diameter through the entire length of said rotor, wherein a first fluid pressure area forms in said control fit while a second fluid pressure area forms in said at least one thrust chamber; and;

wherein said thrust chamber is so dimensioned, that the said second fluid pressure area is slightly higher in axially towards the said rotor directed fluid pressure force, than the sum of the oppositionally directed forces of fluid pressure in said first fluid pressure area and the respective cylinders of said equal diameter through the entire length of said rotor.

Or, as

The device of the above, wherein said first seat center forms a first swing center;

wherein said second radius is formed around an equally located swing center which coincides with said first swing center;

wherein said equally located swing center is located in said one end of said medial shaft;

wherein said second radius is almost equal to said first radius, wherein said first radius forms a first curved surface;

wherein said second radius forms a first complementary surface;

wherein said first curved surface forms a first bearing bed; and, wherein said first complementary surface of said one end of said medial shaft is swingably borne on said first curved surface of said drive flange which forms said first bearing bed while said surfaces are formed by said first and second radii around said first swing center in said first bed and said one end of said medial shaft.

Or, as:

An axial piston type hydraulic or pneumatic device, wherein fluid flows in a plurality of axially directed cylinders in a substantially cylindrical barrel, wherein pistons reciprocate in said cylinders in said barrel, wherein a drive flange contains seats for the bearing and reception of intermediate rods between said drive flange and said pistons, wherein the axis of said disc is inclined relatively to the axis of said barrel and thereby defines, guides or limits the strokes of said pistons in said cylinders; wherein said drive flange and said barrel are located in a common housing, wherein said housing contains in one of its portions entrance ports and exit ports, wherein a stationary control face is provided in a portion of said housing to closely seal along a complementary control face on one end of said barrel to form a control fit between said control faces for the control of flow of fluid from one of said ports into said cylinders and out of said cylinders into the other of said ports; and, wherein said seats in said drive flange form second bearing beds;

wherein said second bearing beds are formed by second curved surfaces of third radii;

wherein said third radii are formed around second swing center;

wherein said second swing center, are equally radially distanced from a first swing center in the axis of said drive flange;

wherein said intermediate rods form inner ends and outer ends;

wherein said outer ends of said rods are part-ball formed and define a second complementary surfaces of fourth radii around said second swing centers;

wherein said fourth radii are almost equal to said third radii;

wherein said outer ends of said rods are borne in said second bearing beds;

wherein said second complementary surfaces engage said second curved surfaces able to slide there along;

wherein a holding ring is mounted on said drive flange for embracing portions of said outer ends of said rods to hold said outer ends in said second bearing beds; and;

wherein said holding ring is provided with an annular face whereof points are able to engage said portions of said outer ends of said rods for preventing said outer ends of said rods from escaping out of said second bearing beds.

Or, as:

An axial piston type hydraulic or pneumatic device, wherein fluid flows in a plurality of axially directed cylinders in a substantially cylindrical barrel, wherein pistons reciprocate in said cylinders in said barrel, wherein a drive flange contains seats for the bearing and reception of intermediate rods between said drive flange and said pistons, wherein the axis of said drive flange is inclined relatively to the axis of said barrel and thereby defines, guides or limits the strokes of said pistons in said cylinders; wherein said drive flange and said barrel are located in a common housing, wherein said housing contains in one of its portions entrance ports and exit ports, wherein a stationary control face is provided in a portion of said housing to closely seal along a complementary control face on one end of said barrel to form a control fit between said control faces for the control of flow of fluid from one of said ports into said cylinders and out of said cylinders into the other of said ports; and, wherein said seats in said drive flange form second bearing beds;

wherein said second bearing beds are formed by second curved surfaces of third radii 58;

wherein said third radii are formed around second swing centers 59;

wherein said second swing centers are equally radially distanced from a first swing center in the axis of said drive flange;

wherein said intermediate rods form inner ends and outer ends;

wherein said outer ends of said rods are part-ball formed and define second complementary surfaces of fourth radii around said second swing centers;

wherein said fourth radii are almost equal to said third radii;

wherein said outer ends of said rods are borne in said second bearing beds;

wherein said second complementary surfaces engage said second curved surfaces able to slide there along;

wherein a holding ring is mounted on said drive flange for embracing portions of said outer ends of said rods to hold said outer ends in said second bearing beds; and wherein said holding ring embraces a portion of said drive flange and includes a holding portion fastened behind said portion of said drive flange to keep said ring and said drive flange permanently fixed together.

Or, as:

An axial piston type hydraulic or pneumatic device, wherein fluid flows in a plurality of axially directed cylinders in a substantially cylindrical barrel, wherein pistons reciprocate in said cylinders in said barrel, wherein a drive flange contains seats for the bearing and reception of intermediate rods between said drive flange and said pistons, wherein the axis of said drive flange is inclined relatively to the axis of said barrel and thereby defines, guides and limits the strokes of said pistons in said cylinders; wherein said drive flange and said barrel are located in a common housing, wherein said housing contains in one of its portions entrance ports and exit ports, wherein a control face is provided in a portion of said housing to closely seal along a complementary control face on one end of said barrel to form a control fit between said control faces for the control of flow of fluid from one of said ports into said cylinders and out of said cylinders into the other of said ports; and, wherein said rods have outer ends and inner ends, wherein said outer ends and inner ends of said rods are part-ball configurated and said outer ends are swingably borne in said seats of said drive flange;

wherein said pistons have rear ends and top ends, wherein said top ends are at least partially formed by part-ball-form hollow spaces with third curved surfaces of fifth radii around third swing-centers;

wherein said third surfaces form third bearing beds, wherein said inner ends of said rods form third complementary surfaces of sixth radii around said third swing centers;

wherein said sixth radii are almost equal to said fifth radii;

wherein said third complementary surfaces are borne on said third surfaces and are able to swing there along around said third swing centers;

wherein said third curved surfaces extend maximally one hundred and eighty degrees around said third swing centers thereby forming surfaces of maximally halves of hollow balls which are axially open in the directions away from said pistons and wherein said inner ends of said rods are thereby able to depart from said third bearing beds when said pistons fail to engage said inner ends of said intermediate rods.

Or, as:

The device of the above, wherein said annular face forms a cone with an inclination relative to the axis of said ring.

Or, as:

The device of the above, wherein said third bearing beds are formed entirely on said top ends of said pistons.

Or, as

The device of the above, wherein said third bearing beds are formed inside of said pistons by which cylindrical portions are formed on said pistons extending from said third bearing beds to said top ends of said pistons.

Or, as,

The device of the above, wherein said pistons are provided with passages extending axially through the length of said pistons;

wherein said pistons are provided with reception chambers extending from said rear ends into said pistons; and, wherein flow-through restriction means are provided in said reception chambers.

Or, also as

The device of the above, wherein one of said ports contains a fluid under a high pressure;

wherein the other of said ports contains a fluid under a second pressure, wherein said second pressure is forced into or maintained in said other of said ports, and, wherein said second pressure is smaller than said high pressure but high enough to assure and maintain the pressing of said third curved surfaces of said pistons onto the said third complementary surfaces of said rods in order to keep said third surfaces in close engagement on each other.

The devices of the invention may be hydraulic or pneumatic devices as pumps or motors but they may also be used as compressors or expanders for engines and the like.

Figure 2:
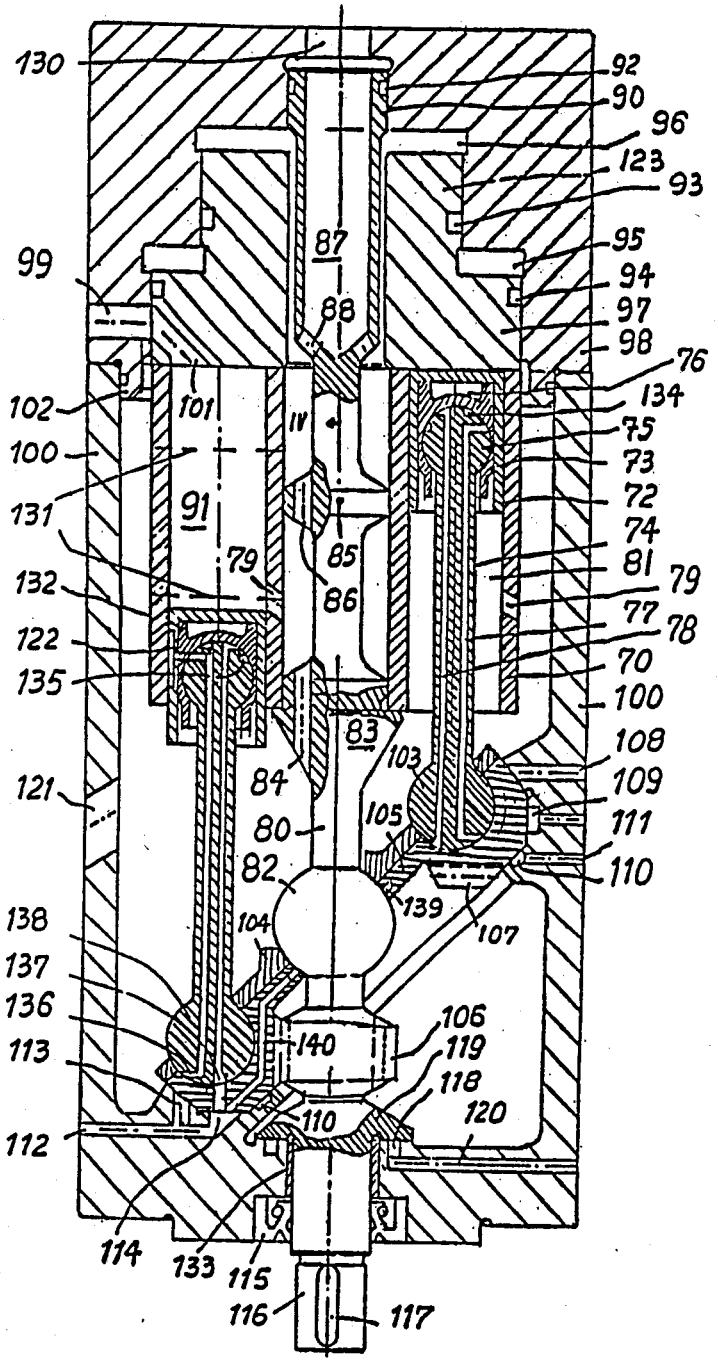
FIG. 2 is a longitudinal sectional view through a further embodiment of the invention.

In FIG. 2, a revolving rotor 70 is driven by shaft 116 or rotor 70 drives shaft 116. Power may be delivered to shaft 116 or taken of therefrom by clutch- or key-means 117. Rotor 70 contains a plurality of cylinder or other working chambers 91 which are generally parallel to the axis of the rotor or inclined thereto. Rotor 70 is therefore occasionally called "a cylinder barrell". Drive plate 105 is inclined under an angle relatively to the axis of the rotor 70 as shown in the drawing under an angle of 45 degrees. That permits piston strokes of up to 3 or more times the diameter of the piston or displacement member 72. When the chambers 91 are round, they are called cylinders. They may however as well as displacement members or pistons 72 have any other cross-sectional figure, if so desired. Holding plate 104 holds the connecting bar heads 103 in respective, preferred hollow ball part formed seats in the drive plate 105. Drive plate 105 may be driven by gearing means 106, 107 from shaft 116 or vice versa. Drive plate 105 may be borne in bearings 109 to 114.

The chambers 91 in the rotor 70 are preferred to be through-bores of equal cross-sectional area through the entire length of rotor 70 and open towards the outer end thereof. The rotor 70 may thus have an outer end face in sealing engangement with a stationary control face 101 on a stationary control body 97 for periodically opening or closing the chambers 91 to passage means in the control body 97.

Figure 3:
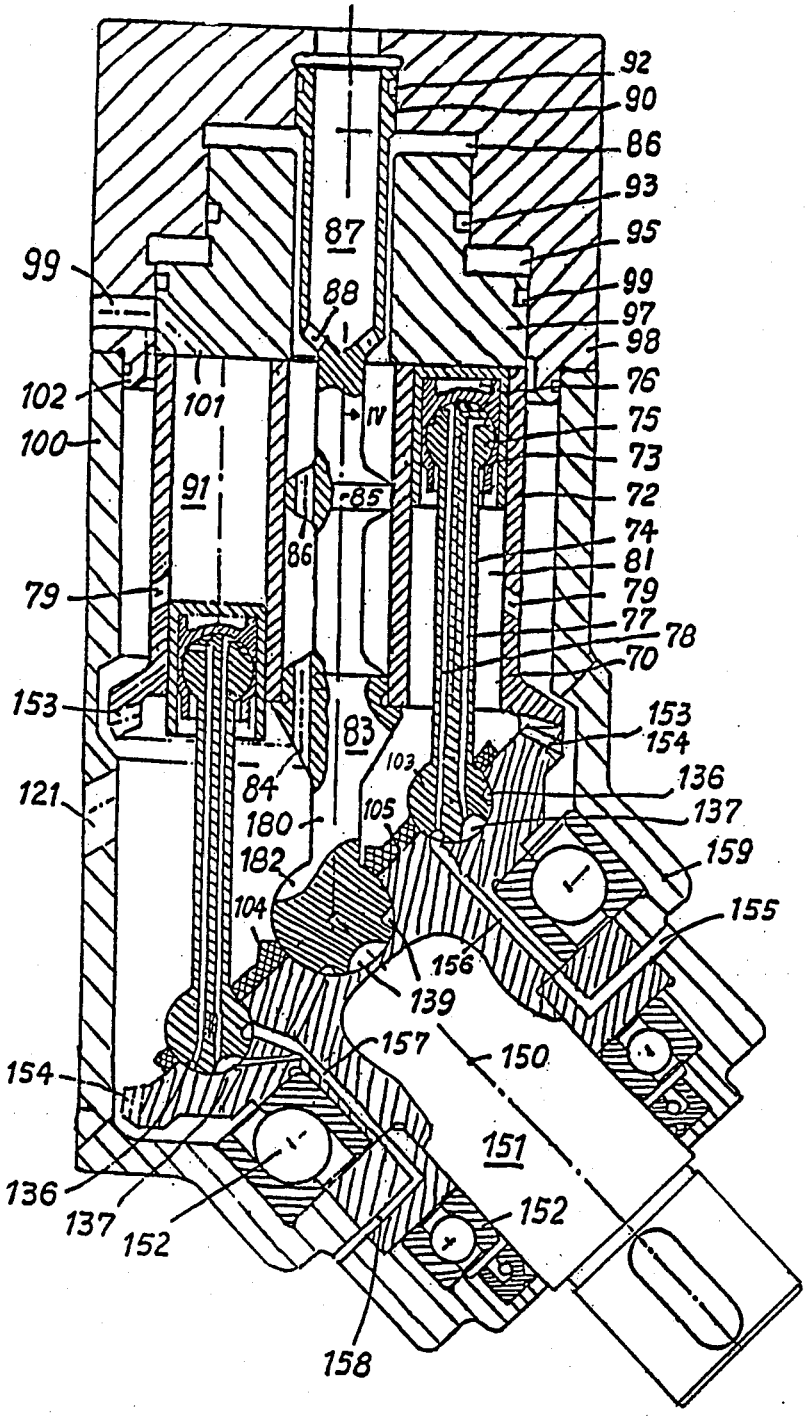
FIG. 3 is a longitudinal sectional view through still another embodiment of the invention.

FIG. 3 shows the engine head cover 98 to contain two fluid containing thrust chambers 95 and 86 whereof at least one contains a fluid under pressure. Control body 97 is inserted into engine head cover 98 and that of the chambers 95 or 86 or both, which contains fluid under pressure presses the control body 97 with its control face or seal face 101 against the end face of the rotor 70 to seal along the rotary face of the rotor 70.

FIG. 2 shows, that control body 97 may have a centric portion close to the rotor 70 and an eccentric portion 123 behind the central portion. Seal means, preferredly heat resistant seal means are provided by 93 and 94 to control body portions 97 and 123 in order to seal the chambers 95 and 96 therebehind. Then eccentric portion 123 prevents rotation of the control body 97.

A combustion chamber may be mounted to one or more compressor devices of FIGS. 2 to 3 and expander device(s) of FIGS. 1 to 3.

According to FIG. 2, the control body and head 97 and 98 may contain a passage 99 for the supply of a cooling flash-fluid, for example, cool air, to flash and cool the respective cylinder at a portion of the rotation of the rotor. The cooling flash-fluid may leave the respective cylinder or chamber 91 through respective cool-fluid exit ports 79 in the rotor and finally the housing of the engine through cool-fluid exit ports 121.

A permanently flowing cooling fluid flow may enter the engine through cooling fluid entrance 130 and flow therefrom through the hollow shaft end 87, leave it through passages 88 to flow into the medial hub or bore of rotor 70 and through further passages 86 and thereafter through radial cooling passages which are radially extending between adjacent cylinders or chambers 91 through rotor 70. After the permanent cooling flow has passed the inner wall of the rotor, cooled it and passed through the radial rotor passages, thereby cooling the rotor 70 and the chambers 91, it leaves the radial passages through the rotor—dotted lines 131—at the radial outer ends thereof and passing the outer face 132 of rotor 70, the permanent, cooling flow also leaves the engine through coolfluid exits 121.

In addition to the heretofore described working actions of the engine parts of FIG. 2 there may be further features incorporated into the respective devices. For example, the shaft 116 may be radially borne in bearings 90 and 133. It may be axially borne in axial bearing 118. Bearing 90 may include a seal 92 for sealing the chamber 96. Rotor 70 may be radially borne on shaft 116 by portions 83 and 85 of shaft 116. The rotor 70 may be axially borne by portion 83 of shaft 116 as far as portion 83 embraces the inner end of rotor 70. Thus, the shaft 116 and rotor 70 are radially and axially borne and thereby able to revolve. The axial position of shaft 116 and rotor 70 are at one end fixed by bearing 118,119 and on the other end by the thrust of chambers 95 or 96 against the controlbody 97 and thereby by the thrust of face 101 of control body 98 against the outer end face of the rotor 70. The chambers 95 and 96 are accordingly dimensioned and located. The details of chambers 95,96 and of control body 98 are calculable from my U.S. Pat. Nos. 3,831,496; 3,850,201; 3,889,577 or 3,960,060.

Pistons 72 may have piston seal rings 129 and they may be hollow or contain insertions 73. The pistons 72 may have spherical ball-part formed beds to contain the ball-part formed inner heads 75 of connecting rods or conrods 74. Conrods 74 may be provided with passages to pass a lubrication, cooling or pressure fluid into respective spaces or recesses in the inner conrod-heads 75.

For example, the rear housing portion may contain lubrication or pressure-fluid entrance passages 108,111,112 or a plurality thereof. Lubrication- and thrust bearing fluid may be passed from them into individual or common fluid pressure thrust or bearing power providing recesses 113,114,108,109,110 and from there through passages 77 or 78 through conrods 74 into conrod inner heads 75 and through them into fluid pressure pockets 134,135 and/or 122. Fluid pressure pockets 134 and 135 bear a part of the pressure excerted from the respective chamber 91 onto the respective piston 70 in order to reduce the mechanical load and/or friction of the respective piston 70 into the respective inner conrod head 75. Fluid pressure pocket 122 may act to bear and counter act partially or totally the centrifugal forces excerted during rotation onto the pistons and or conrods. And fluid pressure pockets 136 and 137, which are communicated to passages 114 or like, may act to bear a part or all of the axial and/or partially radial load of the outer conrod heads 138.

Thrust bearing 118 is supplied with bearing pressure fluid through passage 120. Pressure bearing and lubrication fluid may also be supplied through passage 140 into a fluid pressure pocket 139 around a bearing portion 82, kept between disc 105 and holder 104. Holder 104 may be fastened to inclined disc 105 by respective holding means, not shown. In the Figure, because they may be simple bolts or retaining means. The outer conrod heads 103 or 138 are then held in their seats in inclined disc ring 105 by holding ring 104.

It may be noted, that in the engine, the pressure in the working chambers 91 is not equal as in hydraulic devices, but changing gradually during the respective half of rotation of rotor 70, at which the pistons 70 run from outer position—left side of the Figure—to innermost position—right side of the figure—or vice versa and thereby gradually increase or decrease the volumes of the chambers 91. Consequently, the force exerted by the pressure in the respective chamber 91 onto the respective piston 70 and the respective conrod 74 gradially changes with each half of a revolution of rotor 70. It is therefore preferred to set a plurality of entrance passages 112,111,108 angularly around the periphery of housing 100 and to supply them with different fluid pressures. With lower pressure in those zones, where lower pressure is present in the respective chamber 91, with medial pressure in those zones, where medial pressure acts in the respective chamber 91 and with higher pressure in those zones, where higher pressure acts in the respective chamber 91. As more such separated entrance passages are set, as more detailed will be the counter acting fluid pressure recesses in the conrods and pistons be supplied in order to have such forces as close as possible to bear the forces exerted out of the respective chamber 91 onto the respective piston. In the ideal case the said recesses will bear 80 to 98 percent of the forces exerted from the fluid pressure in the respective chamber 91 onto the respective piston 72. The fluid pressure pockets 122 may be supplied contrary to FIG. 3 by a permanent pressure in order to permanently act contrary to the acting centrifugal forces of pistons and conrods. The Pistons 72 and conrods 74 may for that purpose have devices to prevent their rotation relative to recesses 122 in order to maintain the recesses 122 in direction contrary on the piston to the said centrifugal forces. The conrods 74 may also have return fluid passages 77 or 78 to return the heated fluid out of the respective fluid pressure recesses 122,135,134,136,137 and the like.

In the other embodiment of an engine of the invention, as shown in FIG. 3, the control body and the rotor as well as the means associated to them are similar to those shown and explained in FIGS. 1 and 2.

However, the inclined plate 105 of FIG. 2 and the shaft of FIG. 2 are replaced by a medial shaft 180 and by an inclined drive- or driven axis 150 of a driving or driven shaft 151. Inclined axis shaft 151 may be inclined 20 to 25 degrees relatively to the axis of the rotor 70 and the shaft 154 contains the seats for the outer conrod heads 103 and the seat for the inner head 182 of medial shaft 180. Medial shaft 180 guides and holds the rotor 70 by end bearing 90 and bearing of its outer head 182 in the respective medial seat in shaft 151. Shaft 151 and rotor 70 are revolved in unison for example by the application of gears 154 and 154 on shaft 151 and rotor 70. Holding plate 104 is similar to that of FIG. 2 and fastened to the respective end of shaft 151 which contains the seats for the medial shaft 180 and the conrod heads 103.

The fluid pressure passages 108,111 and-or 112 of FIG. 2 are replaced in FIG. 2 by passages 155,156, 157 and 158. They extend from a portion 159 of the housing through a portion of the shaft 151 and end in the respective seats to supply fluid into the respective recesses 136 and 137 in the outer conrod heads 103 or the seats thereof. They may also lubricate and pressure-supply the recess 139 of the medial shaft head 182 or its seat.

Figure 5:
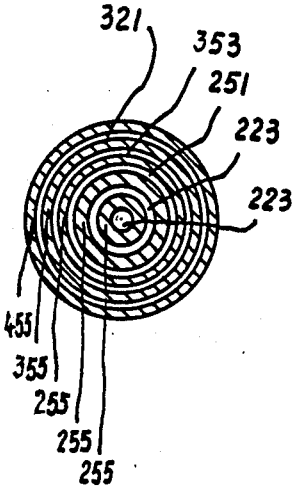
FIG. 5 is a view onto FIG. 4 from the arrow VI.
Figure 4:
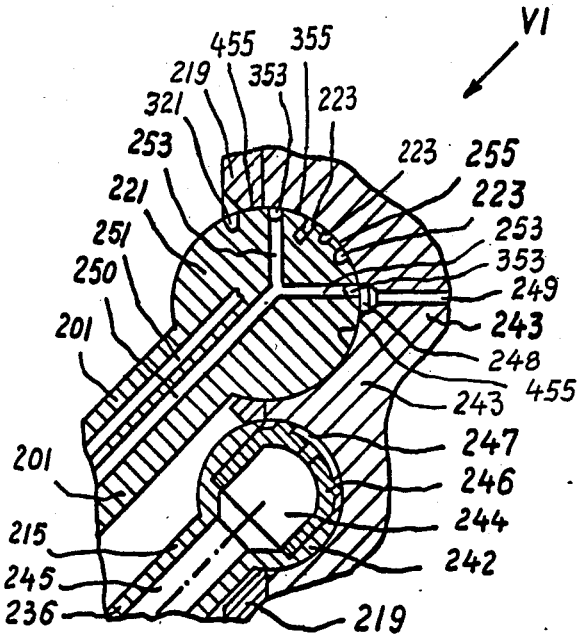
FIG. 4 is a longitudinal sectional view through a portion of a still further embodiment of the invention.

In FIGS. 4 and 5 the element 201 is provided with two separated passages 250 and 251. Passage 251 carries the fluid and pressure from the cylinders 38 or the high pressure control port. Passage 250, however, carries the fluid and pressure of a control flow, which may be supplied and controlled also by remote or automatic control.

The working pressure of the high pressure control part is led through passage 251 into the hydrostatic pressure field 223–225. This may, for obtaining of a maximum of bearing capacity, have a number of recesses 223 and bearing faces 255. See also FIG. 5, which is seen in the direction of arrow VI in a section slightly below the outer face of head 221 of the element 221. The bearing faces 255 are located between two adjacent recesses 223 and thereby lubricated under pressure fluid force from both ends, whereby they obtain the high bearing capacity of the invention.

The several recesses 223 may be communicated with each other through bores or communications in order to fill all of the recesses 223 with working pressure fluid and thereby to secure the lubrication of the bearing faces 255 there between, by which an effective hydrostatic bearing is formed between head 221 of element 201 and flange or shaft 243. Head 221 is fastened to flange or shaft 243 by holder 219 in such a way, that head 221 can still slide spherically in the bed of flange or shaft 243.

The control fluid flow, which is led through passage may pass into a passage extension 253 and port into the control flow recess 353. Control flow recess 353 is separated from the hydrostatic bearing by a common seal face 355 which may obtain in the clearance a fluid pressure of a height between the working pressure of passage 251 and the control flow pressure of passage 250. In the other radial direction the control recess 353 which is in the Figure on annular ring groove, is sealed by the sealing land 455. On the outer end of the sealing land 455 may an unloading recess 321 be provided which unloads at the top-left of FIG. 4 in the neighborhood of referential number 321 into the empty or low-pressure filled housing of the pump or motor.

In a 45 degree inclination between axis of shaft and axis of rotor-device, the annular ring groove, the control flow recess 253, can not easily meet the passage 249, because when the control recess ring groove 53 is set too far outwards, it can not be sealed any more in the hollow half-ball formed bearing bed in flange or shaft 243. See hereto the referential line of 253 in the upper portion of FIG. 4. The control recess ring groove 253 therefore obtains a location as geometrically demonstrated in FIG. 4. When the location would be otherwise, a 45 degree inclination between the shaft and rotor could no more be obtained. In order, that the control recess annular groove 353 can at all times be communicated with the passage 249 to the control means for the member, which shall be controlled by the control flow through the pump or motor, the passage 249 must either be of a suitable diameter or be provided with a port 248 of a precisely located and dimensioned diameter in order to meet the control recess ring groove 353. This communication is demonstrated in FIG. 4. The sealing land or face 455 must here become so large dimensioned in radial direction around the part-ball head 321 that the port or passage 248 or 248 can never meet the unloading recess 321. In short, communication of port or passage 248,249 with unloading recess 321 must be prevented by a suitable dimensioning and location of sealing face or sealing land 455.

When the arrangement is done as shown in FIG. 4 of the invention both aims are perfectly achieved. The hydrostatic bearing is provided on head 211 of element 201 and the control flow is separately passed through element 221 and head 221 into the transfer passage 248 to the shaft and the means to actuate and control the controllable member operated by the control flow through the device like pump or motor.

For high revolutions of the device the invention desires to reduce the centrifugal force of the conrods between the pistons and the flange or connection flange 243. That is done in the bottom portion of the invention thereby, that the head 242 of the respective connecting rod 215 is hollow and obtains a bearing insertion 246 with fluid pressure balancing pocket 247 therein. The insertion 246 may also be hollow to reduce the weight of the connecting rod 215 and its head 242. The shaft 236 of connecting rod 215 may also be hollow. The hollow spaces, here described, may however be filled with light weight non-compressible material in order to prevent compression in fluid in the hollow spaces. Because compression in fluid at high pressure in fluid leads to as higher a volumetric loss, as bigger the hollow spaces are.

The reduction of weight of the connecting rods and of their heads in FIG. 4 is very considerable. This reduction of weight of the conrods is very important at high revolutions, because at high revolutions the centrifugal force of heavy conrods with heavy heads is very high. The centrifugal force trends to force the conrods at high revolutions radially outwardly and thereby one-sided on the wall faces of their respective beds and holders in the flange 243 and its neighborhood. There they produce an increased friction and wearing, when the weights of the conrods are high as in the past and when the revolutions of the rotor and shaft of the device are high.

What is claimed is:

1. An axial piston type hydraulic or pneumatic device, wherein fluid flows in a plurality of substantially axially directed cylinders in a substantially cylindrical barrel, wherein pistons reciprocate in said cylinders in said barrel, wherein a drive flange contains seats for the bearing and reception of intermediate rods between said drive flange and said pistons, wherein the axis of said drive flange is inclined relatively to the axis of said barrel and thereby defines, guides and limits the strokes of said pistons in said cylinders; wherein said drive flange and said barrel are located in a common housing, wherein said housing contains in one of its portions entrance ports and exit ports, wherein a ported control face is provided in a portion of said housing to closely seal along a complementary control face on one end of said barrel to form a control fit between said control faces for the control of flow of fluid from one of said ports into said cylinders and out of said cylinders into the other of said ports;

wherein said drive flange has a medial hollow spherical seat of a first radius around a first seat center;

wherein said barrel is hollow and forms a central hub; wherein said housing contains a first cylindrical seat in one of its portions;

wherein a medial shaft extends through said hub of said barrel and into said medial seat and into said first cylindrical seat; wherein said medial shaft forms at one end of said shaft a part-ball formed head of a second radius and on the other end of said shaft a first cylindrical portion of a diameter able to closely fit and move in said first cylindrical seat;

wherein said head of said medial shaft is swingably borne in said hollow medial spherical seat of said drive flange while said second radius is substantially equal but very slightly shorter than said first radius to enable said head to swing in said medial seat and maintain a close fit between the faces of said head and said medial seat;

wherein said medial shaft forms a shoulder with a substantially radial plane face; wherein said shaft forms at least one fitting to fit in said hub of said barrel to bear against said barrel radially;

wherein said radial plane face extends radially beyond said at least one fitting to bear in axial direction on said radial plane face a substantially radially plane face which is substantially located close to the other end of said barrel;

wherein said first cylindrical portion of said medial shaft is borne in said first cylindrical seat of said housing portion; and wherein said barrel is axially kept between said radial plane face of said shoulder of said medial shaft and said stationary control face in said portion of said housing, wherein said barrel is a rotor and said drive flange is rotary and borne in respective bearings; and wherein a coupling means is provided between said rotor and said drive flange to revolve said drive flange and said barrel in unison wherein said barrel is axially and radially borne by said medial shaft, wherein one of said portions of said housing is hollow and forms at least one thrust-chamber; wherein an axially movable body is inserted into said at least one thrust chamber;

wherein force of high pressure fluid in said at least one thrust chamber presses said axially movable body against said barrel;

wherein said barrel is pressed by said axially movable body against said shoulder of said medial shaft, and, wherein said barrel is axially kept between said shoulder of said medial shaft and said axially movable body while said medial shaft is axially borne by said part-ball-formed head of said medial shaft in said medial hollow spherical seat and radially borne in said medial hollow seat and said first cylindrical seat.

2. The device of claim 1, wherein said first seat center forms a first swing center;

wherein said second radius is formed around an equally located swing center which coincides with said first swing center, wherein said equally located swing center is located in said one end of said medial shaft;

wherein said second radius is almost equal to said first radius, wherein said first radius forms a first curved surface;

wherein said second radius forms a first complementary surface;

wherein said first curved surface forms a first bearing bed; and, wherein said first complementary surface of said one end of said medial shaft is swingably borne on said first curved surface of said drive flange which forms said first bearing bed while said surfaces are formed by said first and second radii around said first swing center in said first bed and said one end of said medial shaft.

3. The device of claim 1, wherein said axially movable body forms said control face, wherein said body forms control ports in said control face, wherein said body has passages to communicate at least one of said control ports with said at least one thrust chamber;

wherein said control face is non-rotary, wherein said barrel forms on the end adjacent to said control face said complementary control face as a rotary control face whereinto said cylinders port, and, wherein said control faces form said control fit.

4. The device of claim 3, wherein said cylinders are straight cylinders which extend with equal diameter through the entire length of said rotor, wheren a first fluid pressure area forms in said control fit while a second fluid pressure area forms in said at least one thrust chamber; and;

wherein said thrust chamber is so dimensioned, that the said second fluid pressure area is slightly higher in axially towards the said rotor directed fluid pressure force, than the sum of the oppositely directed forces of fluid pressure in said first fluid pressure area and the respective cylinders of said equal diameter through the entire length of said rotor.

* * * * *